United States Patent [19]

Minar et al.

[11] Patent Number: 4,698,906

[45] Date of Patent: Oct. 13, 1987

[54] METHOD FOR ATTACHING A PRINTED CIRCUIT BOARD TO A CONNECTOR FOR TESTING PURPOSES

[75] Inventors: Frank M. Minar, State College; Robert L. Wisnieski, Jr., Centre Hall, both of Pa.

[73] Assignee: C-Cor Electronics, Inc., State College, Pa.

[21] Appl. No.: 799,490

[22] Filed: Nov. 19, 1985

[51] Int. Cl.[4] ..... H01R 43/00; H01R 9/09

[52] U.S. Cl. ..... 29/842; 29/832; 29/593; 439/78

[58] Field of Search ..... 339/17 LC, 17 C, 17 R, 339/177 R, 177 E, 88 R; 29/845, 842, 844, 837, 832, 593

[56] References Cited

U.S. PATENT DOCUMENTS

| | | | |
|---|---|---|---|
| 3,059,152 | 10/1962 | Khouri | 339/17 C |
| 3,783,321 | 1/1974 | Patterson | 339/17 LC |
| 4,138,179 | 2/1979 | Miller et al. | 339/17 LC |

FOREIGN PATENT DOCUMENTS

| | | | |
|---|---|---|---|
| 2748818 | 3/1979 | Fed. Rep. of Germany | 339/17 C |
| 1543433 | 10/1968 | France | 339/88 R |
| 755159 | 8/1956 | United Kingdom | 339/177 R |
| 2025161 | 1/1980 | United Kingdom | 339/17 LC |

*Primary Examiner*—Daniel C. Crane

*Attorney, Agent, or Firm*—Stanley J. Price, Jr.

[57] ABSTRACT

This invention relates to a connector for coupling a printed circuit board to an outside circuit and includes means to clamp said connector to said circuit board to form a sturdy circuit element that can be tested for conductivity without requiring spot soldering in the clamped portions. The connector may be readily disconnected from the printed circuit board should the test fail and another printed circuit board readily substituted. The connector, with the printed circuit board clamped thereto, is maintained in clamped relation for further assembly with other assembly elements should the test be passed.

6 Claims, 4 Drawing Figures

10
11
12
14
15
16
17
18
19
20
21
22
23
24
25
26
27
28
29
30
32
34
36
38
38
40
42

METHOD FOR ATTACHING A PRINTED CIRCUIT BOARD TO A CONNECTOR FOR TESTING PURPOSES

BACKGROUND OF THE INVENTION

1. Field of the Invention

This invention relates to means for connecting an electroconductive circuit mounted on a printed circuit board to an outside circuit in such a manner that an operator can test fully and align the electroconductive circuit mounted on the printed circuit board prior to the final assembly of the printed circuit board within a circuit box wherein the printed circuit board is installed for operation. Printed circuit boards are used to modulate or otherwise modify the output of an outside circuit, particularly those producing signals in the radio frequency range.

2. Technological Problems and Prior Art

An increasing number of electric and electronic devices, particularly those that operate at radio frequencies, incorporate a printed circuit board as a component thereof. Printed circuit boards are thin and have a card-like configuration. Consequently, they are delicate and should be tested prior to their final installation in an assembly. However, if the printed circuit board is not supported properly between its test and final installation, its fragility may render it inadequate for use even though it passes its tests. Furthermore, if a defective printed circuit board is installed in its final assembly structure before testing, the printed circuit board must be removed from the final assembly structure, thereby requiring expensive and time consuming operations involved in its disassembly, removal and replacement by another printed circuit board in the final assembly structure.

Some connnector means available in the prior art are provided with one or more slotted portions adapted to receive a printed circuit board adapted to be attached thereto. The slotted portions are constructed and arranged to expose different circuit elements of a circuit printed on said printed circuit board to one or more electrodes of each of two opposite polarities simultaneously by constructing and arranging the positions of the various electrodes carried by the connector means to correlate with those of different circuit elements carried by the printed circuit board so that each said circuit element that is supposed to make electrical contact with a corresponding electrode makes its electrical contact simultaneously when electrical contact takes place between each other circuit element and its associated electrode when the printed circuit board is positioned properly relative to said slotted portions.

One configuration of electrodes in prior art connector means includes a pair of shoulder-type electrodes of one polarity flanking a central electrode of opposite polarity. A second configuration of electrodes in prior art connector means comprises a quartet of electrodes of one polarity arranged at the corners of a rectangular support member surrounding a central electrode of opposite polarity. Still another prior art connector means supports a plurality of circumferentially spaced, arcuately shaped electrodes of one polarity surrounding a central electrode of opposite polarity.

In each of the prior art connector means just described, it is necessary to solder all the electrodes to all of the corresponding circuit elements carried by the printed circuit board in order to insure that all the electrical connections are secure before the assembly combination of printed circuit board and connector means can be adequately tested. Prior to this invention, such solder connections were made after the printed circuit board and its associated connector means were installed as an assembly in a circuit box. In the event the test indicated a defective printed circuit board, the installed assembly had to be removed from the circuit box, all solder connections had to be broken, the defective printed circuit board had to be removed from the slotted portions and another printed circuit board had to be soldered to the connector means and the assembly inserted within the circuit box before another test could be conducted. Otherwise, it would be impossible to salvage the relatively expensive connector means for use in another assembly with an operable printed circuit board.

At the time of this invention, the printed circuit board art required an improvement enhancing the efficiency of fabricating and assembling radio frequency circuits that incorporate printed circuit boards to insure that a minimum of defective printed circuit boards are assembled in their final assembly with connector means. The needed improvement required that tests of the printed circuit board may be made before the assembly of printed circuit board, connector means and installation box is completed without invalidating the test results during handling that follows the test. The improvement was also needed to avoid postponing the test of the printed circuit board until after the final assembly step takes place.

SUMMARY OF THE INVENTION

According to this invention, a connector of special construction is provided that cooperates with an apertured printed circuit board of special construction to enable the connector and printed circuit board to interfit with one another so that electrodes carried by the connector are able to make simultaneous contact with corresponding electroconductive circuit portions carried by the printed circuit board by a simple mechanical movement that results in a secure clamped attachment between the connector and the printed circuit board. Such an attachment makes it possible to avoid the need for soldering at least some of the connections between the electrodes carried by the connector and the corresponding electroconductive circuit elements carried by the printed circuit board before testing. The intermediate assembly of the connector and printed circuit board formed by mechanical clamping only may be tested for electroconductivity of the circuit elements without need to complete the final assembly of the complete unit as required by the prior art.

If the test is successful, the intermediate assembly unit comprising the connector and printed circuit board of this invention may be kept as an integral assembly element of the final unit until its final assembly with a circuit box with reduced fear of damage to the intermediate unit between the test and the final installation in the circuit box. Also, the reduction of solder connections required with this invention compared with those required with prior art connectors and printed circuit boards avoids the need for as many expensive, time-consuming disassembly steps required to break all the solder connections of the test unit should the prior art unit fail the test and as many reassembly steps of the prior art that requires a solder application at each connection between an electrode carried by the connector and a corresponding circuit element carried by the printed circuit board to replace a defective unit in an intermediate assembly that fails a test.

The integrity of the test results performed on an intermediate assembly formed by clamping a connector to a printed circuit board as taught by the present invention is superior to test results performed on an assembly that depends solely upon soldered connections without the readily removable clamping force suggested by this invention. That is because an intermediate assembly of connector and printed circuit board that is clamped together to form a unitary structure is less likely to become defective before its final assembly within a circuit box than an intermediate assembly that depends on solder connections mainly for electrical coupling.

The details of the benefits derived from this invention will be understood better in the light of a description of a specific preferred embodiment that follows.

DESCRIPTION OF THE DRAWINGS

In the drawings that form part of a description of a preferred embodiment of this invention.

DESCRIPTION OF PREFERRED EMBODIMENTS

Figure 1:
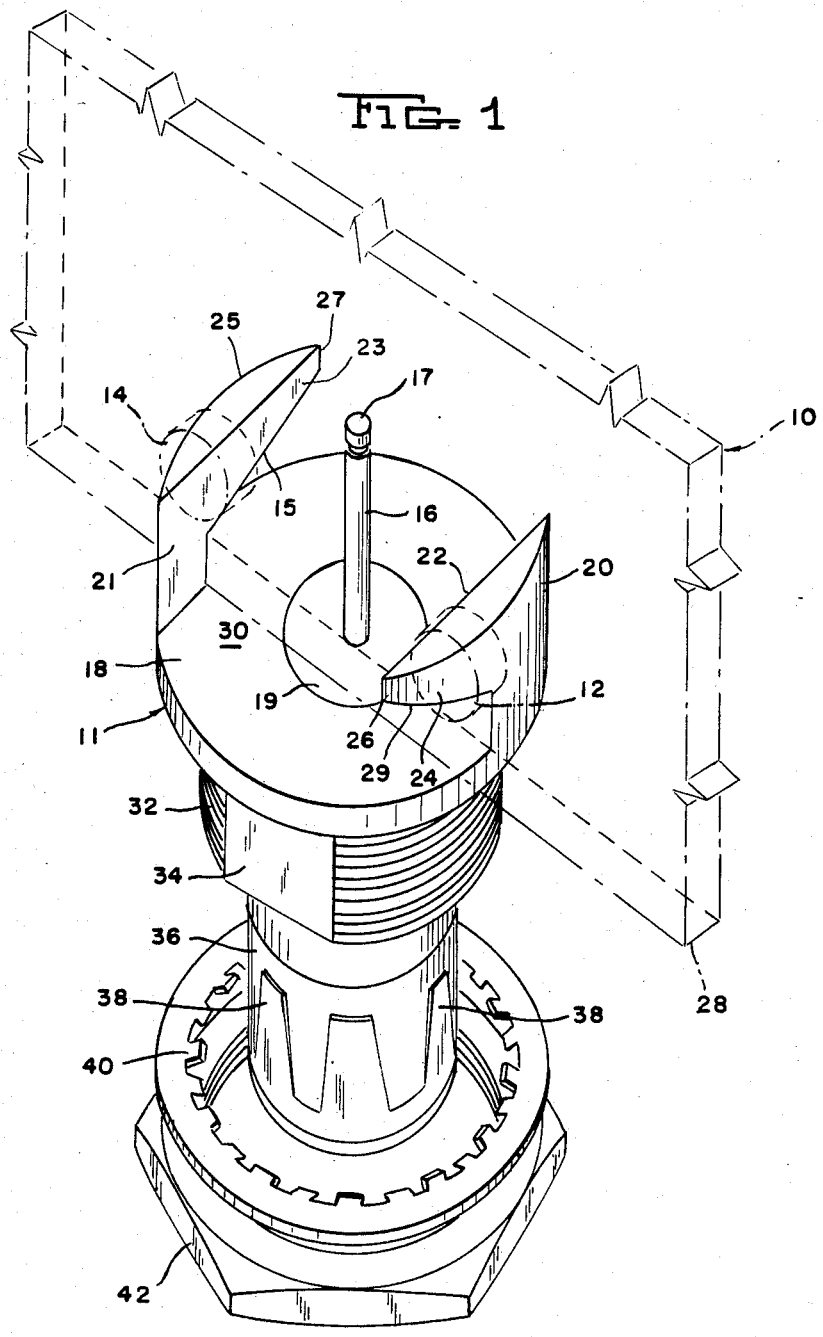
FIG. 1 is an isometric view of a connector conforming to this invention shown in clamped relation to a printed circuit board forming therewith an assembly to be tested and retained as a sturdy assembly element for use in a final assembly with minimum chance of damage between the test and final assembly should the printed circuit pass its test, with circuit elements omitted from the printed circuit board to show other structure more clearly.
Figure 3:
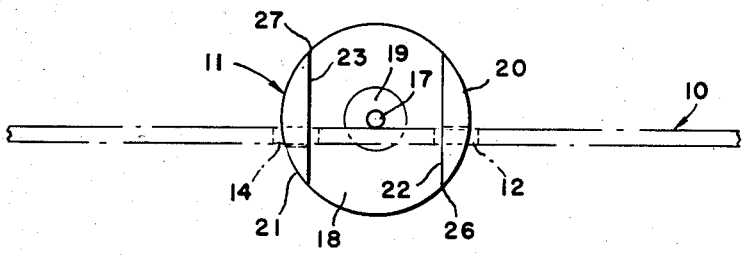
FIG. 3 is a fragmentary view similar to FIG. 2 showing the relative positions of the connector to the printed circuit board after the connector and printed circuit board have been clamped together to form an intermediate assembly ready for testing, as taught by this invention.
Figure 4:
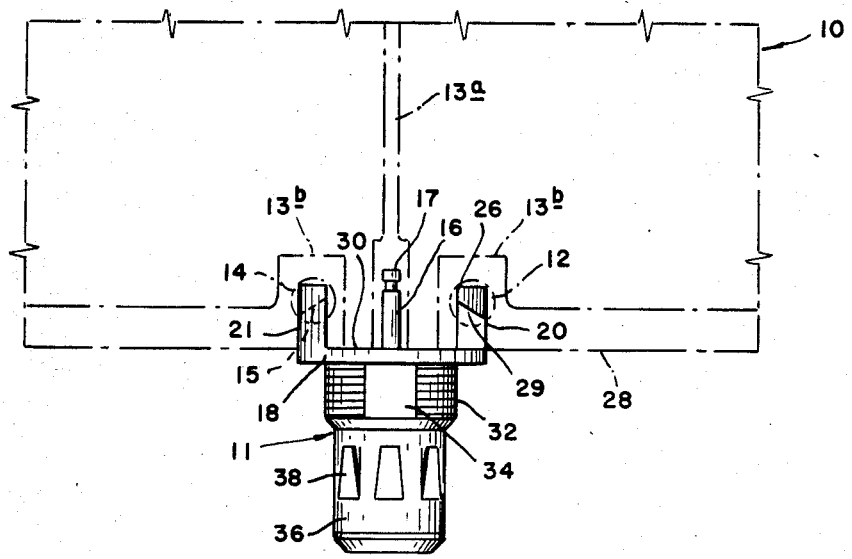
FIG. 4 is a fragmentary elevational view taken at right angles to FIG. 3 and showing parts of the electroconductive circuit carried by the printed circuit board omitted from FIG. 1.

A printed circuit board 10 is shown clamped to a connector 11 conforming to this invention in FIGS. 1, 3 and 4. Printed circuit board 10 is provided with a pair of circular apertures 12 and 14 of equal diameter through the thickness of the board. The circumferential walls of apertures 12 and 14 are coated with a continuous circumferential coating of electroconductive solder. A printed circuit carried by printed circuit board 10 has a first electroconductive element 13*a* spaced from apertures 12 and 14 and midway therebetween. The printed circuit also includes additional electroconductive elements 13*b*, shown in FIG. 4, that are electrically connected with the solder coatings on the circumferential walls of circular apertures 12 and 14. Printed circuit board 10 has an edge surface 28 that is flat. Board 10 is usually composed of a dielectric material such as fiberglass, reinforced plastic or the like.

Connector 11 has an axially extending electrode that serves as a positive electrode 16 of a given diameter that includes an electroconductive button 17 (also of said given diameter) at its free end just beyond a portion of reduced diameter. The exact shape of positive electrode 16 shown may be modified, but it is convenient to use the positive electrode 16 in the shape illustrated because such electrodes are readily available in the open market as stock items. Connector 11 also includes a flat surfaced abutment member 18 of electroconductive material that surrounds a central portion 19 of dielectric material through which axially extending electrode 16 extends.

The length of axially extending electrode 16 is such that when a flat surface 30 of abutment member 18 abuts flat edge surface 28 with axially extending electrode 16 extending inward from edge surface 28 along a major surface of printed circuit board 10, electroconductive button 17 and a length of electrode 16 on the other side of the reduced diameter portion make electrical contact with first electroconductive element 13a.

Abutment member 18 supports a pair of upstanding, L-shaped fingers 20 and 21 at equal distances from and in flanking relation to axially extending electrode 16. L-shaped fingers 20 and 21 are preferably of metal harder than solder and have upper portions that form prongs that extend from axial digits that connect the prongs to abutment member 18. The prongs are multisided with flat radially inner walls 22 and 23 in planes extending parallel to the axis of positive electrode 16, convexly rounded radially outer walls 24 and 25 that remain from a cut-away cylinder having axially extending electrode 16 as an axis and axially lower walls 29 and 15 that extend obliquely from the axial digits to form a pointed end 26 for finger 20 and a pointed end 27 for finger 21, respectively. The pointed ends 26 and 27 are pointed in opposite directions from one another. The adjacent surfaces of each prong form sharply bent elongated corners. The fingers 20 and 21 provide negative electrodes for connector 11 and are composed of a hard electroconductive metal in the illustrated embodiment. However, the polarity of electrodes 16 and fingers 20 and 21 may be reversed without departing from the gist of this invention.

Circular apertures 12 and 14 are spaced from one another by a distance approximately equal to the diametrical distance between corresponding portions of the prongs. Pointed ends 26 and 27 of the prongs of L-shaped fingers 20 and 21, respectively, have a cross-section that is less than the cross section of apertures 12 and 14, but the cross-section of each prong increases away from ends 26 and 27 along its length at a rate of increase that is equal for the prongs to a cross-section that at least equals that of apertures 12 and 14. This structure makes it easy for pointed ends 26 and 27 to enter apertures 12 and 14 simultaneously and as connector 11 rotates in the direction of pointed ends 26 and 27, cause the prongs to wedge into apertures 12 and 14 where the sharp corners between adjacent walls of the relatively hard prongs penetrate and distort the relatively soft circumferential solder coatings for apertures 12 and 14 until the prongs form gas-tight seals with the solder coatings.

In addition to abutment member 18, connector 11 comprises a plurality of axially aligned housing portions including an externally threaded housing portion 32 of generally cylindrical configuration except for one or more pairs of diametrically opposed flat portions 34 adapted to receive a tool such as a spanner to rotate connector 11 about an axis defined by axially extending electrode 16 to clamp the prongs into apertures 12 and 14 simultaneously when rotating the connector in the direction of pointed ends 26 and 27. Housing portion 32 is integral with abutment member 18 and extends therefrom in a direction opposite the end of positive electrode 16 occupied by electroconductive button 17. Another housing portion 36 is integral with housing portion 32 and extends axially beyond housing portion 32.

A plurality of spring-loaded tabs 38 is circumferentially spaced about housing portion 36. Tabs 38 are electroconductive and electrically connected to L-shaped fingers 20 and 21, which are also electroconductive. Housing portions 32 and 36 form a male housing adapted to make electrical connection with electroconductive elements carried by a female housing (not shown) through electrodes that connect an outer circuit (not shown) to axially extending electrode 16 and tabs 38. Thus, radio frequency signals are carried at a first polarity through electrode 16 to first circuit element 13*a* and at an opposite polarity through tabs 38, L-shaped fingers 20 and 21, their prongs and the connections between the prongs and the circumferential solder coatings for aperatures 12 and 14 to additional circuit elements 13*b*.

A lock washer 40 and a hexagonal nut 42 surround the threaded outer surface of externally threaded housing portion 32 when printed circuit board 10 is installed within an apertured circuit box (not shown) during final installation. Details of the latter will be described later.

Figure 2:
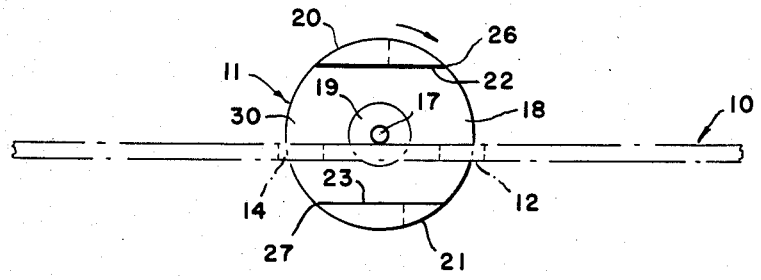
FIG. 2 is a fragmentary end view of the printed circuit board of FIG. 1 looking down on the upper end of the connector of FIG. 1 when the latter is in position ready to be rotated relative to the printed circuit board to form with said printed circuit board an intermediate assembly that can be subjected to electrical testing without requiring excessive spot soldering prior to said testing.

In order to assemble the connector 11 to a printed circuit board 10 according to this invention, the latter may be supported on or clamped to the upper surface of a table having a cut-away portion. Apertures 12 and 14 of the printed circuit board are aligned over the cut-away portion of the table. Connector 11 is then brought into engagement with printed circuit board 10 with flat inner walls 22 and 23 parallel to and flanking the major surfaces of printed circuit board 10, flat surfaced abutment member 18 adjacent edge surface 28 and axially extending electrode 16 bearing against one of the major surfaces of printed circuit board 10 as shown in FIG. 2. With this set-up, button 17 and a length of electrode 16 extending from its reduced diameter portion contact first circuit element 13*a*. Connector 11 is then rotated in the direction of pointed ends 26 and 27 of L-shaped fingers 20 and 21 until their prongs enter apertures 12 and 14. Rotation is continued until the prongs fit snugly to form gas-tight contact with the circumferential solder coatings on apertures 12 and 14. The oblique bottom surfaces 15 and 29 force flat surface 30 of abutment member 18 into rigid clamping relation against edge surface 28 as rotation continues. The printed circuit board is now ready for testing without requiring any spot soldering, because wedging the prongs to fit snugly against apertures 12 and 14 and abutting abutment member 18 against edge 28 provides a triangle of engagement areas that holds electrode 16 and its electroconductive button 17 in contact with first circuit element 13*a*, while the prongs clamp against the electroconductive coating of apertures 12 and 14. Thus, testing can be performed without requiring any prior spot soldering after clamping.

If the test fails, it is a simple matter to rotate connector 11 in the direction opposite the pointed ends to disengage the prongs of L-shaped fingers 20 and 21 from circular apertures 12 and 14 and flat surface 30 from edge surface 28, using a spanner to engage flat portions 34 to accomplish the disengagement. Once disengaged, it is a simple matter to remove the printed circuit board 10 and replace the defective board with another one to be tested.

If the test is successful, connector 11 is maintained in clamped relation with printed circuit board 10 by maintaining the prongs of L-shaped fingers 20 and 21 in gas-tight contact with the circular apertures 12 and 14 and abutment member 18 engaging edge surface 28. The resulting structure is an integral intermediate assembly element that remains intact until it is installed within the opening of a circuit box (not shown) during final assembly with housing portions 32 and 36 extending outside the circuit box. During this final installation, abutment member 18 together with its L-shaped fingers 20 and 21 locked into apertures 12 and 14 is inserted with printed circuit board 10 through an access opening in the circuit box, lock washer 40 is moved against the outer wall of the circuit box and nut 42 is threaded around the externally threaded surface of housing portion 32 until the wall portion of the circuit box surrounding its access opening is rigidly clamped between abutment member 18 on one side and washer 40 and nut 42 on the other side.

Some operators prefer to apply additional solder to the connections between electrodes 16 and the prongs of the connector 11 on one hand and the first circuit element 13*a* and the solder coating around apertures 12 and 14 carried by printed circuit board 10 on the other hand after the test is successful as a matter of excessive precaution. Other operators prefer to solder the connection of axially extending electrode 16 and/or its electroconductive button 17 with first circuit element 13*a* after clamping and before the test is performed. However, the mechanical clamping of the prongs against the apertures 12 and 14 provides a sufficiently strong electrical connection as to avoid the need for these latter solder connections between the prongs and apertures 12 and 14 before testing. In contrast, prior art connectors required additional spot soldering for each electrical connection between corresponding electroconductive elements of the printed circuit board and electrodes of the connector because prior art devices did not take advantage of the rotating clamping force included in this invention. Also, prior art connectors of which we are aware do not take advantage of moving pointed ends of pointed clamping elements of a connector in the direction of the thickness of the printed circuit board to which it is assembled to clamp prongs of increasing thickness against apertures, which is a reason why spot soldering is needed at all connections of prior art devices of which we are aware, but may be omitted for at least some of the connections, if not all of the connections of the present invention, prior to testing.

Since shelf items having electroconductive buttons 17 at the end of a connecting portion of reduced diameter are available for use as axially extending electrodes 16 for connector 11, they can be used even in cases where the first electroconductive circuit element 13*a* carried by printed circuit board 10 is spaced from electrode 16 when abutment member 18 abuts edge surface 28. In this case, wire may be entrained about the reduced diameter portion to be held in place between button 17 and the main body of electrode 16 and extended from said reduced diameter portion to a remote first circuit element 13*a* for a spot solder connection thereto. In this case, should a test of the printed circuit board 10 so modified but otherwise including the other elements of the preferred embodiment of this invention result in failure, only the spot solder connection involving the wire and the first circuit element 13*a* need be broken to replace the failed printed circuit board with another board.

In this latter embodiment, the wire connection from the reduced diameter portion of electrode 16 may support two or more wires entrained at one end around the reduced diameter portion of electrode 16 and extending toward different circuit elements carried by the printed circuit board. In fact, one or more of the connections by wire may lead to a circuit element carried by each of the opposite major surfaces of the printed circuit board. In such case, one or more wires may be threaded through a thin hole through the thickness of the circuit board to its engagement with the reduced diameter portion of electrode 16. Preferably, the thin hole is aligned with the reduced diameter portion of electrode 16 when flat surface 30 engages edge surface 28. In this modification, the rotational clamping force between the prongs and the apertures makes additional spot soldering unnecessary in the clamped connections between the prongs and the apertures prior to testing. Only the wire to circuit element connections need be soldered prior to a test of an assembly unit of a printed circuit board and a connector constructed and arranged according to this invention.

The form of this invention just described represents a preferred embodiment and certain modifications thereof. It is understood that additional changes in structure may be made in the light of this disclosure without departing from the gist of the invention as defined by the claimed subject matter that follows.

We claim:

1. A method of clamping a connector to a printed circuit board comprising, selecting a printed circuit board having a pair of circular apertures spaced a given distance from one another, an edge surface, and supporting a first electroconductive circuit portion and additional electroconductive circuit portions spaced from said first electroconductive circuit portion, selecting a connector comprising a housing, an axially extending electrode extending beyond said housing in the axial direction of said housing and a pair of L-shaped fingers, each having a prong with a pointed end, said prongs having oppositely extending pointed ends extending transverse to said axial direction and flanking said axis at equal spacing therefrom, said prongs being separated from one another by approximately said given distance and having cross-sections that are less than the cross-sections of said apertures at their pointed ends and gradually increase in cross-section at equal rates of increase along their length away from their pointed ends to cross-sections that at least equal those of said apertures, applying said housing to said printed circuit board in such a manner that said axially extending electrode contacts a major surface of said printed circuit board approximately midway between said apertures and said prongs point in opposite directions on opposite sides of the major surfaces of said printed circuit board, and rotating said housing in the direction of said pointed ends to bring said prongs into said apertures, and continuing said rotation until said prongs are clamped within said apertures.

2. A method as in claim 1, including selecting a printed circuit board having an electroconductive coating extending circumferentially of the inner wall of each said circular aperture in electrical connection with said additional electroconductive circuit portions and selecting a connector having electroconductive L-shaped fingers so that said pointed prongs make electrical contact with said additional electroconductive circuit portions when clamped against said apertures without requiring additional spot soldering therebetween.

3. A method as in claim 2, followed by testing said selected printed circuit board while said selected connector is clamped thereagainst.

4. A method as in claim 3, followed by maintaining said connector and said printed circuit board in said clamped relation for completion of assembly of said connector and said printed circuit board with other components should said printed circuit pass said test.

5. A method as in claim 3, followed by rotating said connector in the direction opposite said pointed ends to disengage said prongs from said apertures, discarding said printed circuit board, selecting another printed circuit board to replace said discarded printed circuit board should the first named printed circuit board fail said test.

6. A method as in claim 1, including providing an axial component of motion to said housing to clamp the latter against said edge surface while rotating said housing in the direction of said pointed ends.

* * * * *